US007331685B2

(12) United States Patent
Shen et al.

(10) Patent No.: US 7,331,685 B2
(45) Date of Patent: Feb. 19, 2008

(54) NAILER WITH AN ILLUMINATION DEVICE

(75) Inventors: Yao Sheng Shen, Taichung (TW); Sunking Hung, Taichung (TW); Leo Huang, Taichung (TW); Sam Yu, Taichung (TW); Shin Nan Chang, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 11/588,944

(22) Filed: Oct. 26, 2006

(65) Prior Publication Data

US 2007/0039992 A1 Feb. 22, 2007

Related U.S. Application Data

(63) Continuation-in-part of application No. 11/169,611, filed on Jun. 28, 2005, now abandoned.

(51) Int. Cl.
*B25B 23/18* (2006.01)

(52) U.S. Cl. ..... 362/119; 277/8; 277/156

(58) Field of Classification Search ..... 227/8, 227/156; 362/119, 203, 204, 253; 408/16, 408/241 R See application file for complete search history.

(56) References Cited

U.S. PATENT DOCUMENTS 2,517,882 A * 8/1950 Johnson ..... 173/46
4,962,681 A * 10/1990 Yang ..... 81/54
5,169,225 A * 12/1992 Palm ..... 362/118
5,954,458 A * 9/1999 Lee ..... 408/16
6,494,590 B1 * 12/2002 Paganini et al. ..... 362/119
6,644,825 B2 * 11/2003 Lin ..... 362/119
2006/0289595 A1 * 12/2006 Shen et al. ..... 227/8

FOREIGN PATENT DOCUMENTS

DE 19860918 A1 * 3/2000

* cited by examiner

*Primary Examiner*—Thanh K. Truong
*Assistant Examiner*—Michelle Lopez
(74) *Attorney, Agent, or Firm*—Charles E. Baxley

(57) ABSTRACT

A nailer with an illumination device located adjacent to the muzzle thereof comprises a nailer and an illumination device. The nailer has a muzzle defined at a front end of a housing thererof, between the muzzle and the housing is arranged a panel and a protection hood covered on the panel, and on the protection hood is formed a notch aligned with the muzzle. Beneath the protection hold is disposed a circuit board, on the circuit board is battery. A positioning hole is defined in a side of the protection hood facing the housing. A buffer is disposed in the positioning hole of the protection hood in such a manner that a part of the buffer protrudes out of the positioning hole and is to be pressed against the housing. The illumination device is disposed beneath the protection hood of the nailer and located correspondingly to the notch.

3 Claims, 6 Drawing Sheets

NAILER WITH AN ILLUMINATION DEVICE

This application is a continuation of part of U.S. patent application Ser. No. 11/169,611 filed on Jun. 28, 2005 now abandoned, which claims the benefit of the earlier filing date.

BACKGROUND OF THE INVENTION

1. Field of the Invention

The present invention relates to a nailer with an illumination device located adjacent to the muzzle thereof, and more particularly to a nailer whose illumination device is located beneath a protection hood and the light of the illumination device can be projected onto the muzzle and the object to be nailed.

2. Description of the Prior Arts

Nailer as a power tool has been widely used in different activities: such as house decoration, furniture manufacture, box sealing. In application, nailer is sometimes used under a poor illumination condition, especially when nailing a work piece with grooves or holes, or when the light is blocked by the object to be operated, things will get worse. Working in a poor illumination condition will not only affect the nailing operation but also will increase the risk of accident.

The problem will be fixed if the nailer can be provided with an illumination device. However, at which position of the nailer the illumination device can be properly fixed will be another problem, because of the following factors:

First, putting the illumination device on the handle portion of the nailer will make gripping uncomfortable, besides, the distance between the handle portion and the muzzle of the nailer is large, so that the light of the illumination device is difficult to be projected onto the muzzle or the object to be operated.

Second, if fixing the illumination device on the muzzle panel of the nailer, it will make it difficult to open the muzzle panel when the nail get jammed.

Third, if fixing the illumination device on the magazine, then the illumination device cannot be used when replacing the magazine or reloading.

Fourth, if the illumination device is fixed on the housing of the nailer, it will protrude out of the surface of the nailer and may be impacted during application.

Fifth, the illumination device must be set at a proper position, not too far and not too close to the muzzle, otherwise, the light cannot be projected onto the right space between the muzzle and the object to be operated.

SUMMARY OF THE INVENTION

The primary objective of the present invention is to provide a nailer with an illumination device located adjacent to the muzzle thereof, wherein the illumination device is disposed in a protection hood and the light of the illumination device can be projected onto the muzzle and the object to be nailed, thus providing the user an optimum light resource.

The secondary objective of the present invention is to provide a nailer with an illumination device, wherein the illumination device is disposed in the protection hood, thus the protection hood can protect the illumination device from being impacted during nailing operation. And a buffer is arranged between the protection hold and the housing for absorbing the vibration generated during nailing operation, and preventing the illumination device from vibrating.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
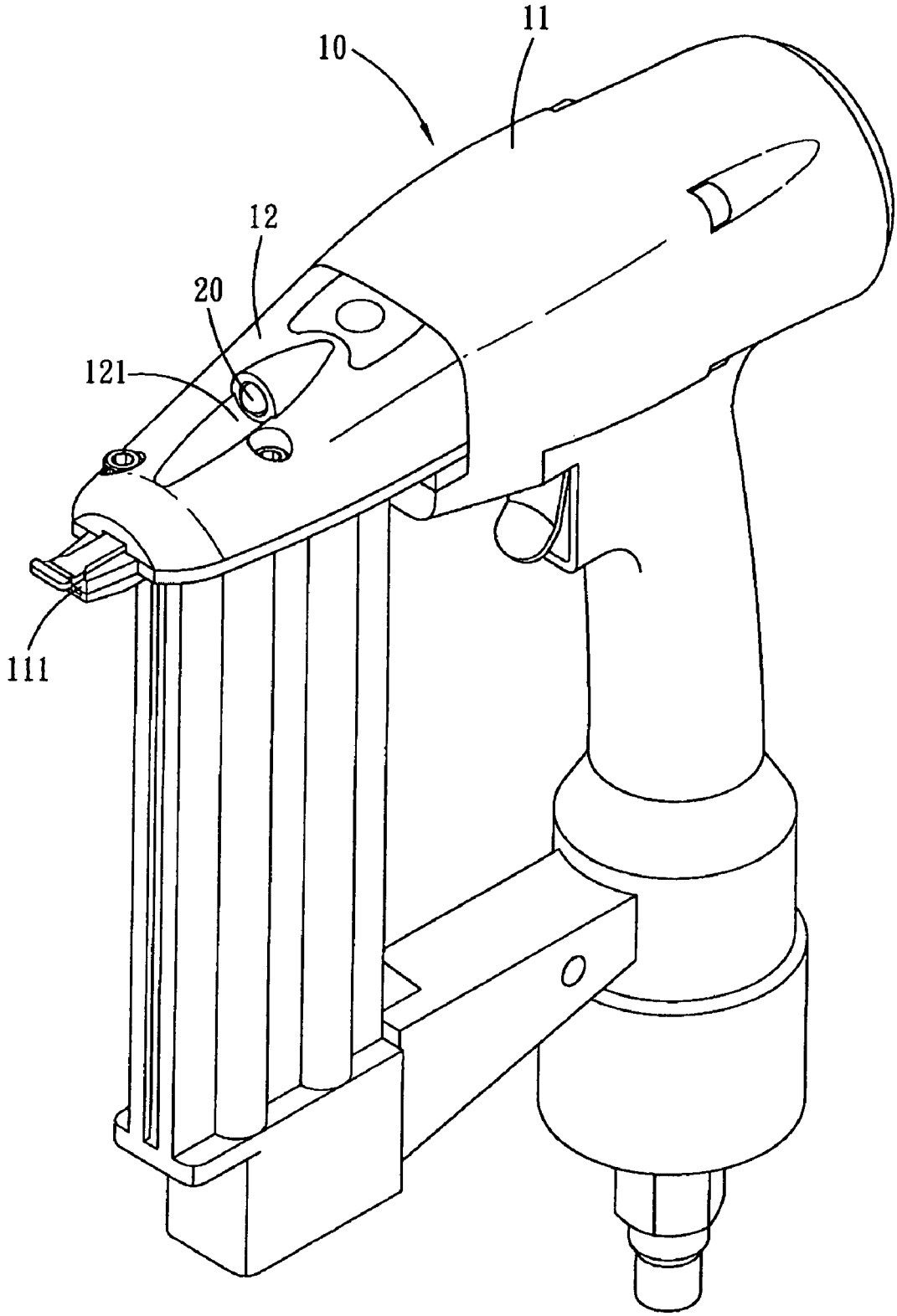
FIG. 1 is a perspective view of a nailer with an illumination device in accordance with the present invention.
Figure 2:
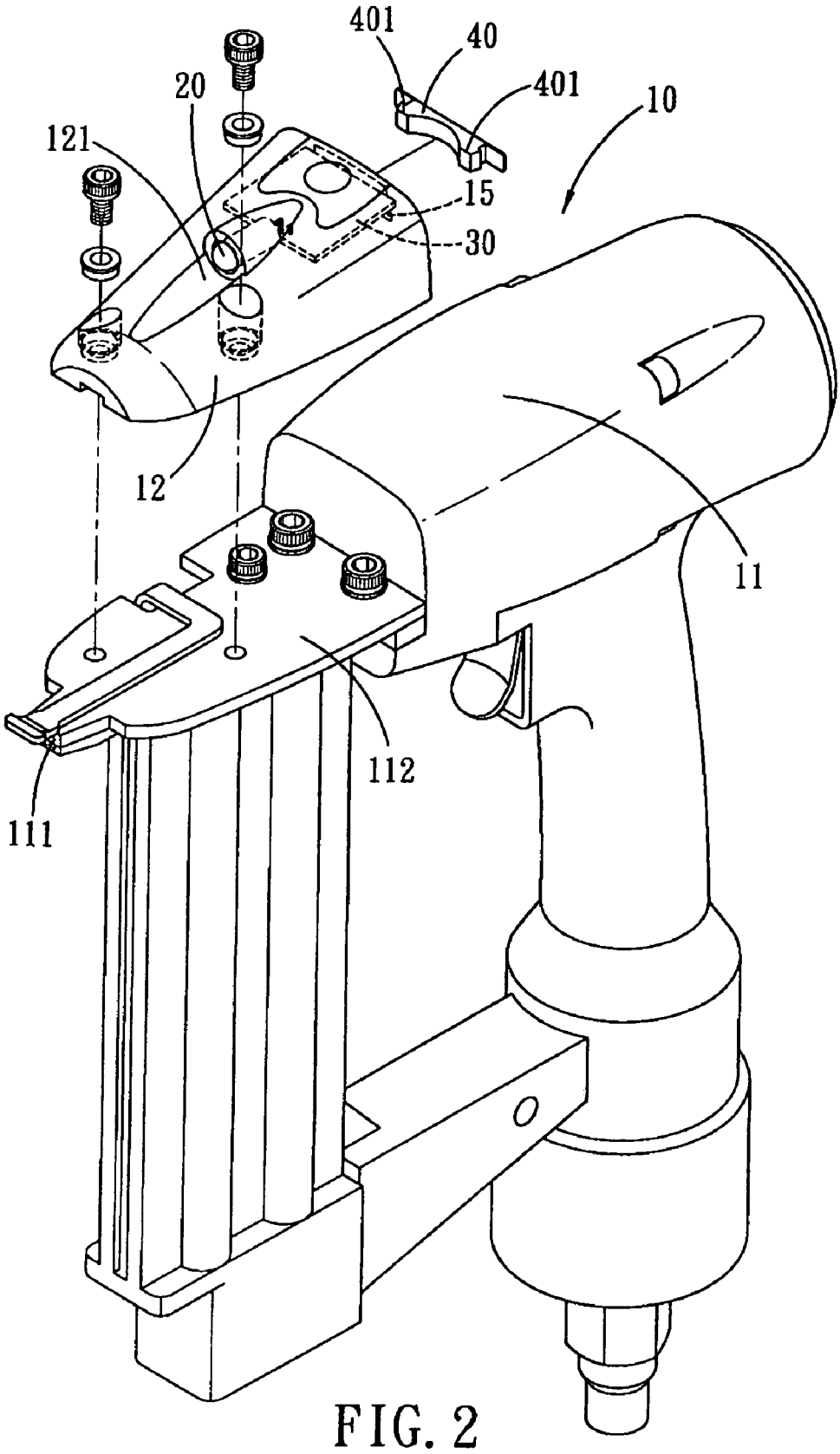
FIG. 2 shows that the protection hood of the nailer with an illumination device in accordance with a first embodiment of the present invention is being opened, wherein the buffer has a protruding portion to be protruded out of the positioning hole of the protection hood.

To achieve the aforementioned objects, the present invention provides a nailer with an illumination device, as shown in FIGS. 1 and 2, the illumination device is disposed in the protection hood of the nailer.

The nailer 10 has a muzzle 111 defined at the front end of a housing 11 thereof, through the muzzle 111 nail is slammed out of the nailer 10. Between the muzzle 111 and the housing 11 is a panel 112 that is covered with a protection hood 12, and the protection hood 12 is fixed to the housing 11 by screws. On the protection hood 12 is formed a notch 121 that is aligned with the muzzle 111. In the protection hood 12 is further disposed a circuit board 30 electrically connected to the illumination device 20, and a battery 50 is mounted on the circuit board 30 for supplying electric power to the illumination device 20. In a side of the protection hood 12 facing the housing 11 is formed a positioning hole 15.

The illumination device 20 is disposed in the protection hood 12 of the nailer 10 and located correspondingly to the notch 121.

Figure 6:
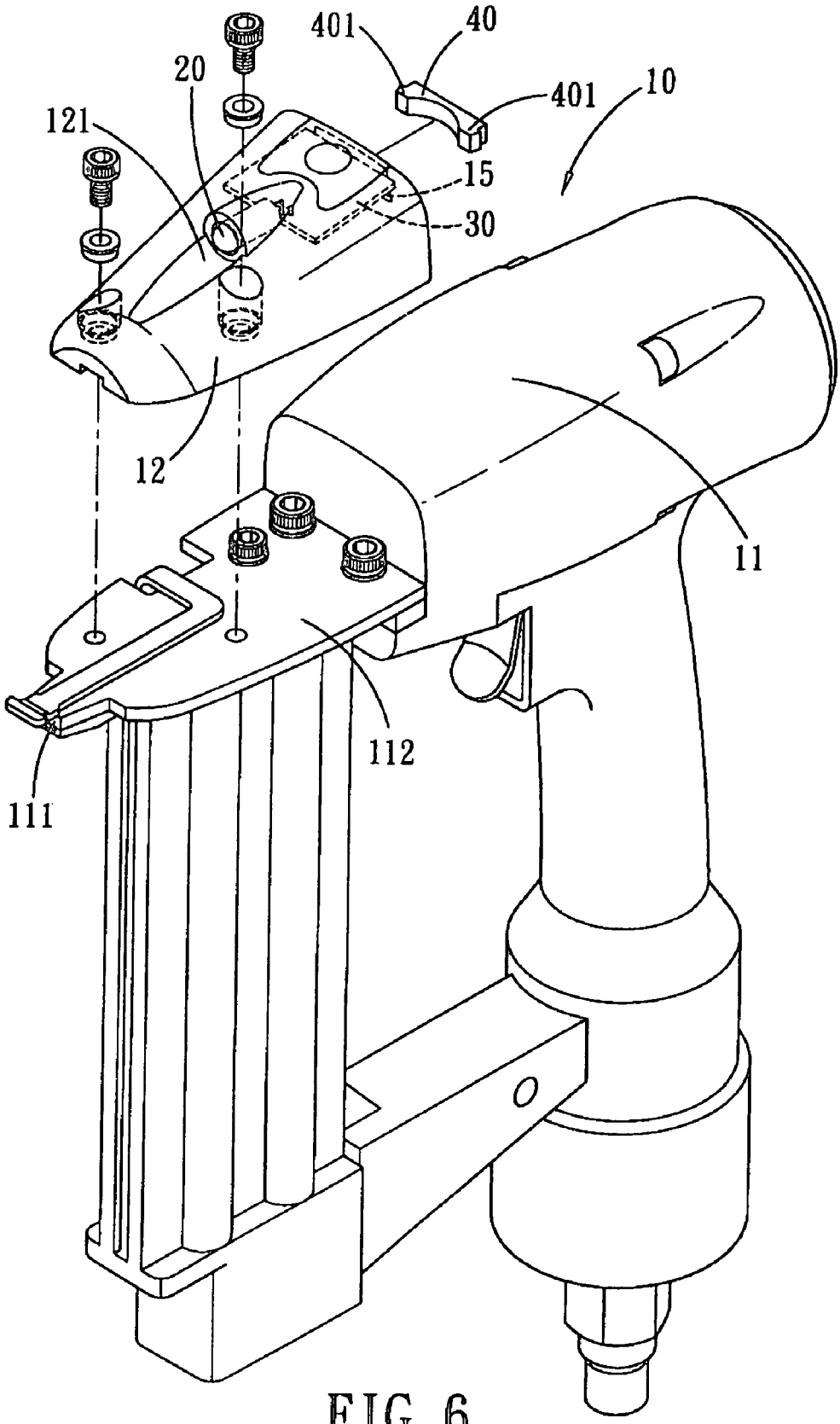
FIG. 6 shows that the protection hood of the nailer with an illumination device in accordance with a second embodiment of the present invention is being opened, wherein the buffer doesn't have a protruding portion.

A buffer 40 with a protruding portion 401 is engaged in the positioning hole 15 of the protection hood 12 in such a manner that the protruding portion 401 of the buffer 40 protrudes out of the positioning hole 15 and is to be pressed against the housing 11 (as shown in FIG. 2). Or the buffer 40 without a protruding portion is fully engaged in the positioning hole 15 of the protection hood 12 (as shown in FIG. 6).

Figure 3:
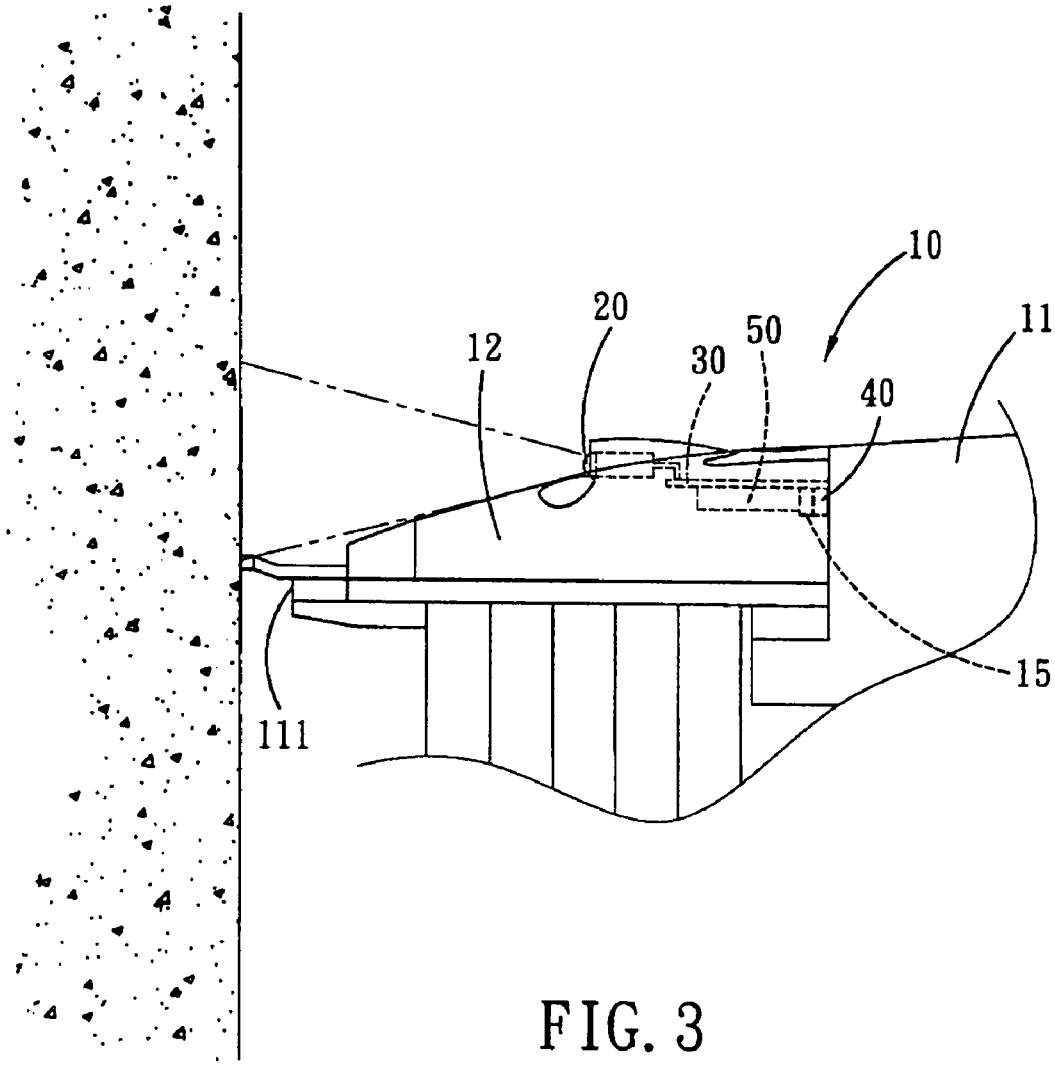
FIG. 3 is an operational view of the nailer with an illumination device in accordance with the present invention.
Figure 4:
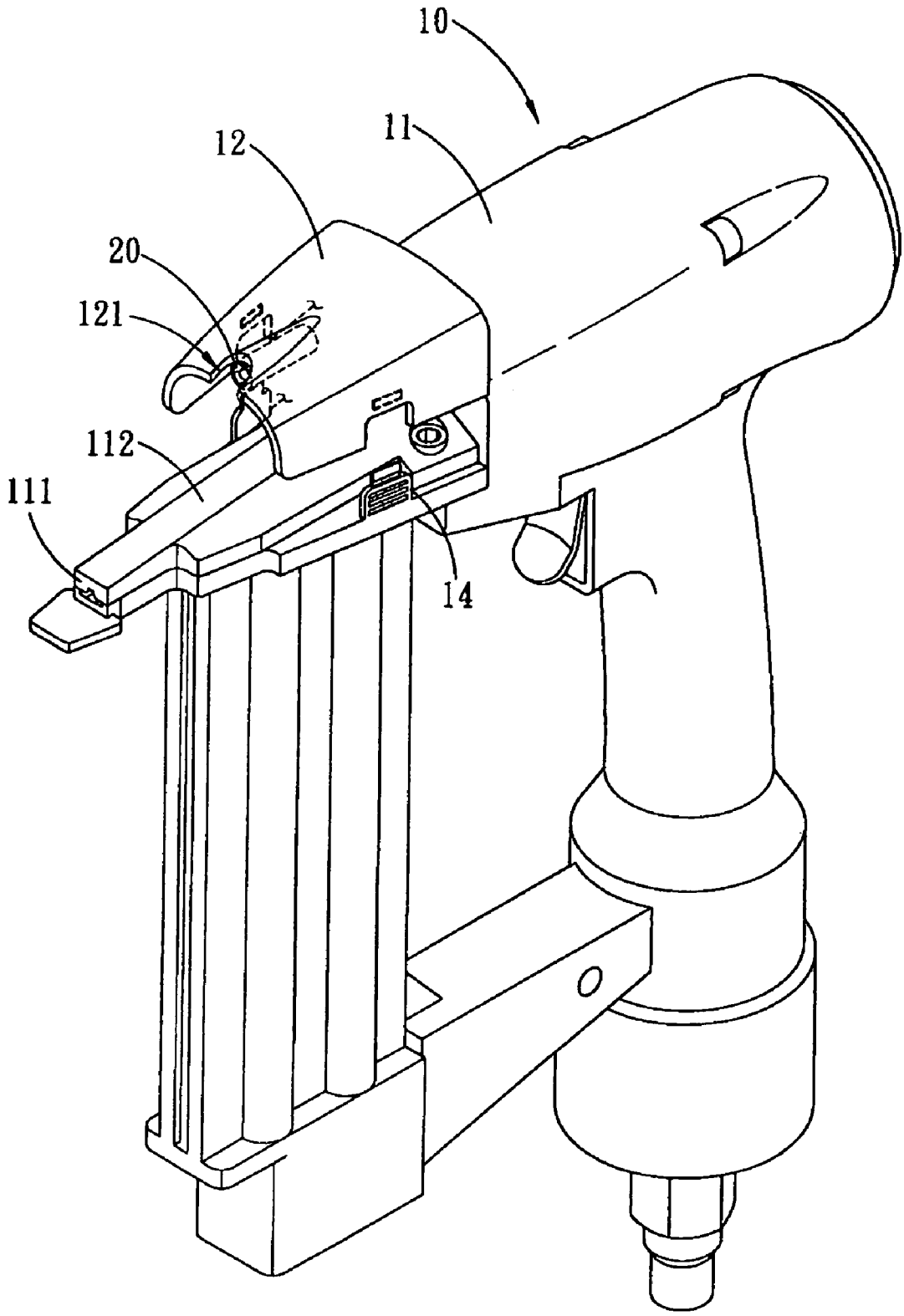
FIG. 4 shows that the protection hood of another nailer with an illumination device in accordance with the present invention is being removed.

When the illumination device 20 is turned on, light will be projected to the muzzle 111 and the object to be operated via the notch 121 of the protection hood 12. The distance between illumination device and the muzzle 111 is such that the light of the illumination device will form a projection area on the object to be operated, thus providing the user an optimum light source (as shown in FIG. 3).

It is to be noted that impact and vibration are inevitable during nailing operation, the protection hood 11 protects the illumination device 20 from impact, and the buffer 40 can absorb the vibration and prevent the illumination device 20 from vibrating. Furthermore, the protection hood 12 is a known component of the nailer 10, therefore, arranging the illumination device 20 beneath the protection hood 12 doesn't need to add any extra structure to the nailer, but also can provide an optimum illumination position for the nailer.

Figure 5:
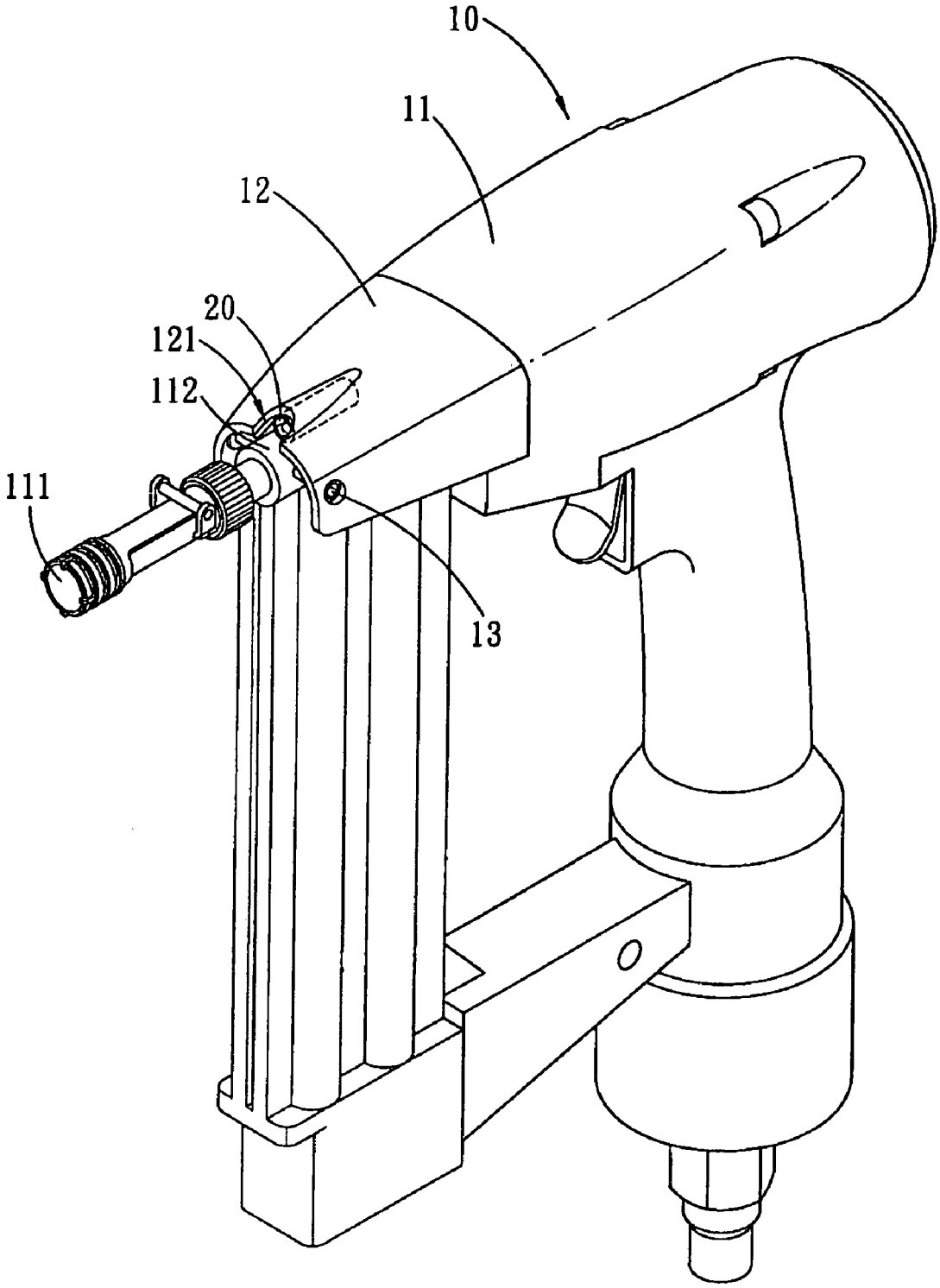
FIG. 5 is a perspective view of a nailer with an illumination device in accordance with another embodiment of the present invention.

In addition, the arrangement of the illumination device beneath the protection hood is almost applicable to all kinds of nailers. For example, the nailer as shown in FIG. 1 is a flat muzzle type nailer, while the nailer in FIG. 5 is a tubular muzzle type nailer.

In addition, the protection hood 12 also can be secured to the nailer 10 by a locking mechanism 14.

While we have shown and described various embodiments in accordance with the present invention, it should be clear to those skilled in the art that further embodiments may be made without departing from the scope of the present invention.

What is claimed is:

1. A nailer with an illumination device located adjacent to a muzzle thereof comprising:

a nailer having a muzzle defined at a front end of a housing thererof, between the muzzle and the housing arranged a panel and a protection hood covered on the panel, on the protection hood being formed a notch aligned with the muzzle, beneath the protection hood being disposed a circuit board, a battery mounted on the circuit board, a positioning hole defined in a side of the protection hood facing the housing;

a buffer being engaged in the positioning hole of the protection hood;

an illumination device disposed in the protection hood of the nailer and located correspondingly to the notch, the illumination device being electrically connected to the circuit board;

the buffer is engaged in the positioning hole of the protection hood in such a manner that a protruding portion of the buffer protrudes out of the positioning hole and is to be pressed against the housing.

2. The nailer with an illumination device as claimed in claim 1, wherein the protection hood is secured to the nailer by screws.

3. The nailer with an illumination device as claimed in claim 1, wherein the protection hood is secured to the nailer by a locking mechanism.

* * * * *